US010458138B2

(12) United States Patent
Masterson

(10) Patent No.: US 10,458,138 B2
(45) Date of Patent: Oct. 29, 2019

(54) UNDERWATER PLATFORM INSTALLATION IN AN EXISTING SWIMMING POOL

(71) Applicant: Thomas Joseph Masterson, Ramsey, NJ (US)

(72) Inventor: Thomas Joseph Masterson, Ramsey, NJ (US)

(73) Assignee: SHAREQUIP, INC., Marco Island, FL (US)

( * ) Notice: Subject to any disclaimer, the term of this patent is extended or adjusted under 35 U.S.C. 154(b) by 86 days.

(21) Appl. No.: 15/790,296

(22) Filed: Oct. 23, 2017

(65) Prior Publication Data

US 2019/0048605 A1 Feb. 14, 2019

Related U.S. Application Data

(60) Provisional application No. 62/545,044, filed on Aug. 14, 2017.

(51) Int. Cl.

| | |
|---|---|
| ***E04H 4/14*** | (2006.01) |
| ***E06C 1/39*** | (2006.01) |
| ***E06C 1/36*** | (2006.01) |
| *E06C 7/08* | (2006.01) |
| *E06C 7/16* | (2006.01) |
| *E06C 7/48* | (2006.01) |

(52) U.S. Cl.

CPC ..... *E04H 4/144* (2013.01); *E06C 1/36* (2013.01); *E06C 1/39* (2013.01); *E06C 7/081* (2013.01); *E06C 7/165* (2013.01); *E06C 7/482* (2013.01)

(58) Field of Classification Search

CPC ..... E04H 4/144; E06C 1/39

USPC ..... 4/574.1, 496

See application file for complete search history.

(56) References Cited

U.S. PATENT DOCUMENTS

| | | | | |
|---|---|---|---|---|
| 3,586,124 | A | 6/1971 | Kunzweller | |
| 4,538,314 | A | 9/1985 | Baranowski | |
| 4,603,758 | A * | 8/1986 | Pettit | E04H 4/144 182/106 |
| 4,912,785 | A * | 4/1990 | Inman | E04H 4/144 15/257.01 |
| 5,065,840 | A * | 11/1991 | Cadigan | E04H 4/144 182/106 |
| 5,307,527 | A | 5/1994 | Schober | |
| 6,311,343 | B1 | 11/2001 | Wisniewski | |
| 6,637,045 | B1 | 10/2003 | Larsen | |
| 6,966,405 | B2 * | 11/2005 | St-Pierre | E04H 4/144 182/93 |
| 7,017,709 | B1 | 3/2006 | Laymance | |
| 7,735,457 | B2 | 6/2010 | O'Connor | |
| 7,950,078 | B2 * | 5/2011 | Houpt | E04F 13/0862 4/574.1 |

(Continued)

*Primary Examiner* — Janie M Loeppke

(74) *Attorney, Agent, or Firm* — Buckley, Maschoff & Talwalkar LLC

(57) ABSTRACT

A retro-fit installation modifies the existing pool ladder structure of an existing in-ground or above-ground swimming pool to support an underwater "swim out" platform structure. In some versions, the ladder rails of the existing pool ladder are used to support the underwater platform, while in others the existing pool ladder rails are replaced with new tubular platform rails specifically designed to support the underwater platform structure. Other versions are adapted for installations in a round pool or at a corner of a rectangular pool.

16 Claims, 8 Drawing Sheets

(56) References Cited

U.S. PATENT DOCUMENTS

| | | | | |
|---|---|---|---|---|
| 9,474,380 | B2 | 10/2016 | Chlapaty | |
| 2002/0133870 | A1* | 9/2002 | Weiss | E04H 4/144 4/496 |
| 2008/0092285 | A1 | 4/2008 | Petersen | |
| 2009/0100587 | A1 | 4/2009 | Smith | |
| 2011/0099708 | A1 | 5/2011 | Freedman | |
| 2016/0206108 | A1 | 7/2016 | Muller et al. | |
| 2016/0367034 | A1 | 12/2016 | Johnston et al. | |

* cited by examiner

UNDERWATER PLATFORM INSTALLATION IN AN EXISTING SWIMMING POOL

REFERENCE TO RELATED APPLICATION

This application claims the benefit of the filing date of U.S. Provisional Patent Application No. 62/545,044, filed Aug. 14, 2017, which is incorporated herein in its entirety.

FIELD OF INVENTION

The present invention relates to the general field of swimming pools, and more particularly to an underwater platform installation that utilizes existing components of an existing swimming pool.

BACKGROUND OF THE INVENTION

A "swim out" is a flat platform, bench or seat in or along the walls of a swimming pool that allows a swimmer in the deep end of the pool to stand or sit without getting out of the pool or going to the shallow end. Installation of a conventional swim out in an existing pool is very expensive and time consuming, since it requires that the pool be drained and one or more of its walls reconstructed. The present invention provides a quick and inexpensive retrofit swim out installation for existing in-ground and above-ground swimming pools.

SUMMARY OF THE INVENTION

The present invention modifies the existing pool ladder structures of an existing swimming pool to support an underwater "swim out" platform structure. In some embodiments of the present invention, the treads of the existing pool ladder are removed and replaced with the underwater platform structure, while the ladder rails and other remaining structures of the existing pool ladder and its attachments to the pool deck are retained. In other embodiments, the existing pool ladder rails are replaced with new tubular platform rails specifically designed to support the underwater platform structure. Some embodiments of the present invention are designed to be installed at a corner of an existing swimming pool or along a curved side wall of the pool. One embodiment is designed for installation in an above-ground pool.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1A:
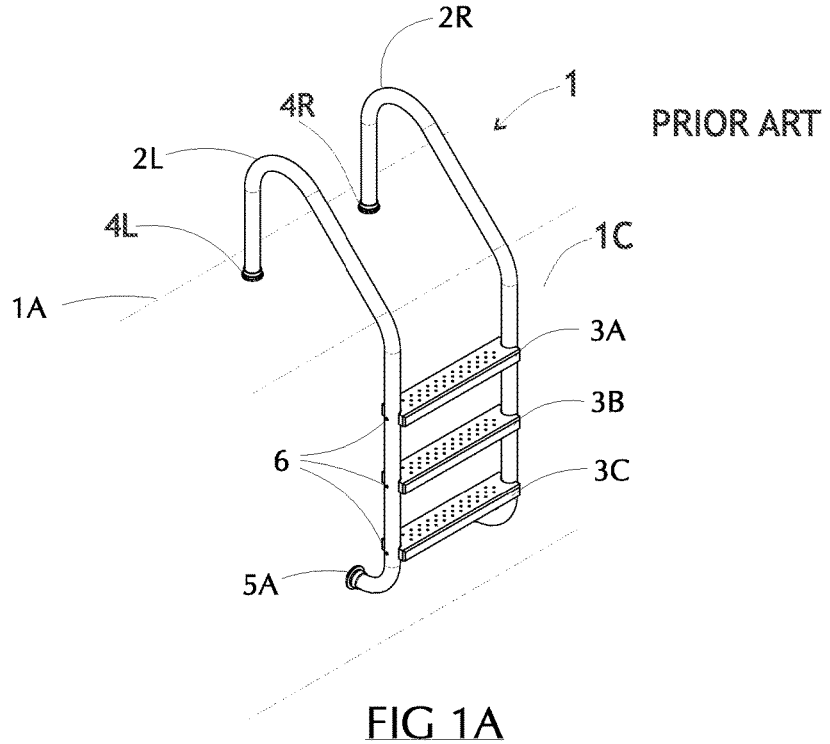
FIGS. 1A-1C are perspective, side profile and front elevation views, respectively, of an exemplary conventional pool ladder of an in-ground pool.
Figure 1B:
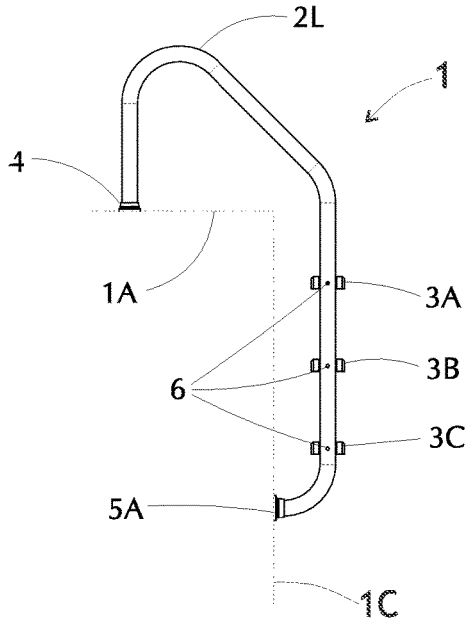
Figure 1C:
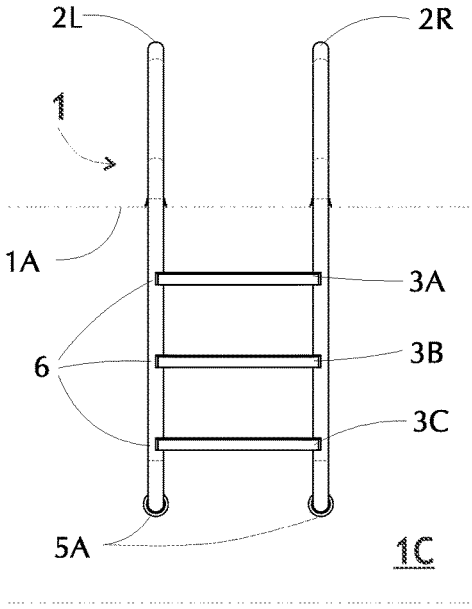
Figure 2A:
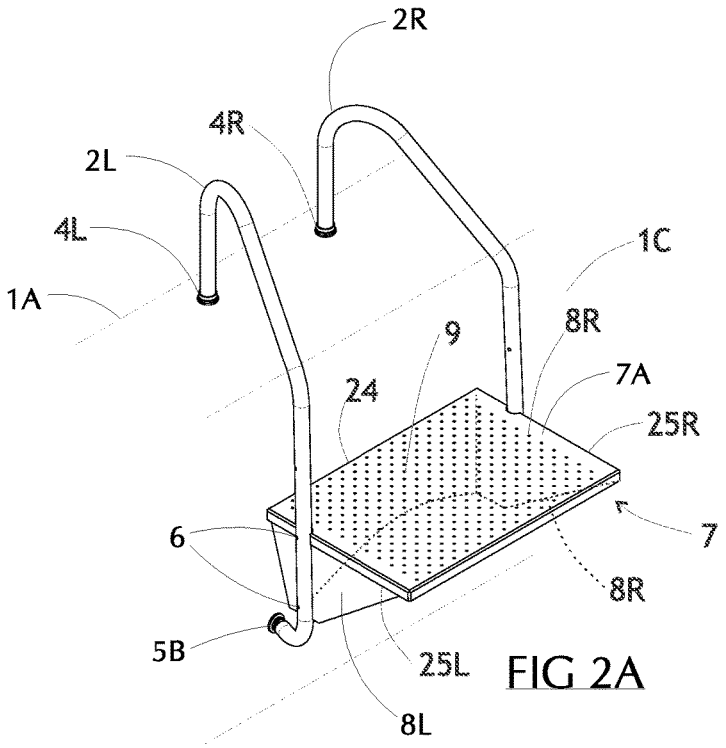
FIGS. 2A-2C are perspective, side profile and plan views, respectively, of a first embodiment of the present invention, which is adapted for installation in a rectangular in-ground pool.
Figure 2B:
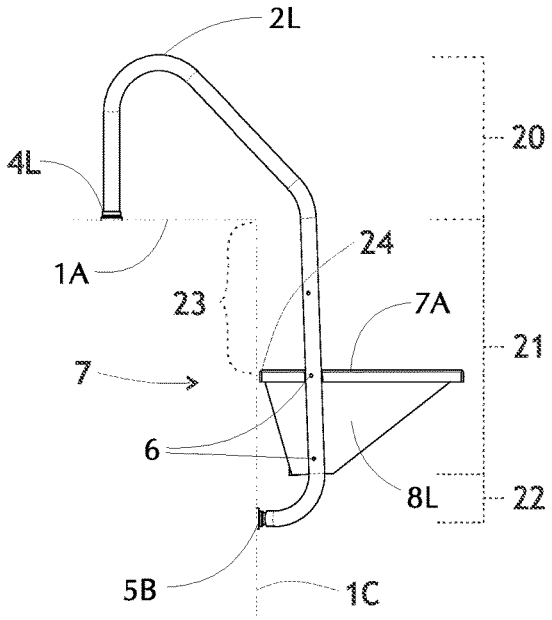
Figure 2C:
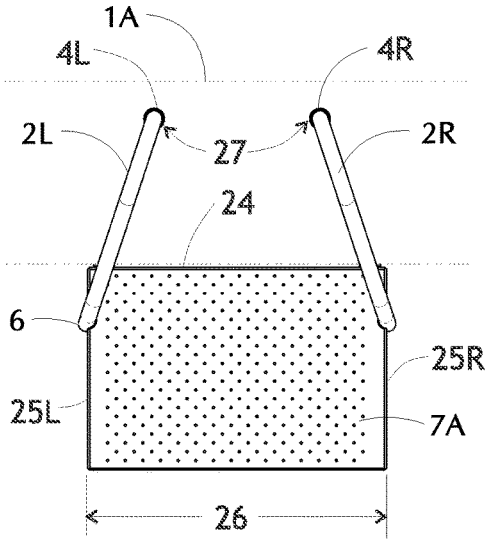
Figure 3A:
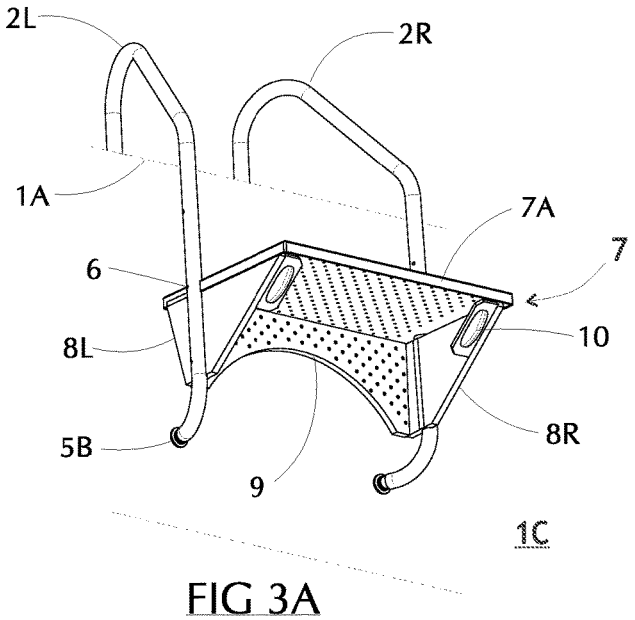
FIGS. 3A-3C are perspective, side profile and front elevation views, respectively, of the first embodiment of the present invention, with LED light bars on the side gussets of the platform structure.
Figure 3B:
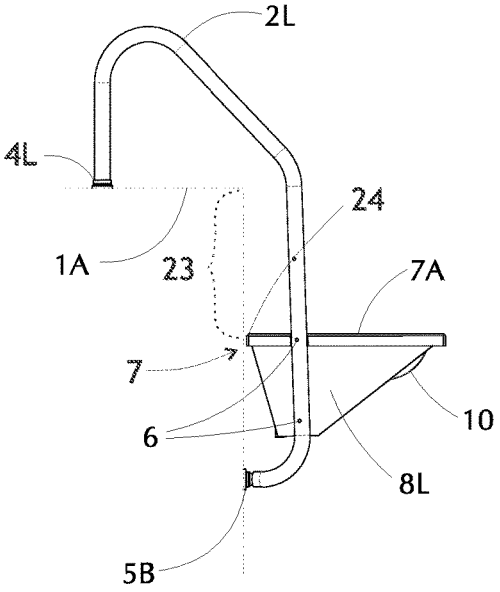
Figure 3C:
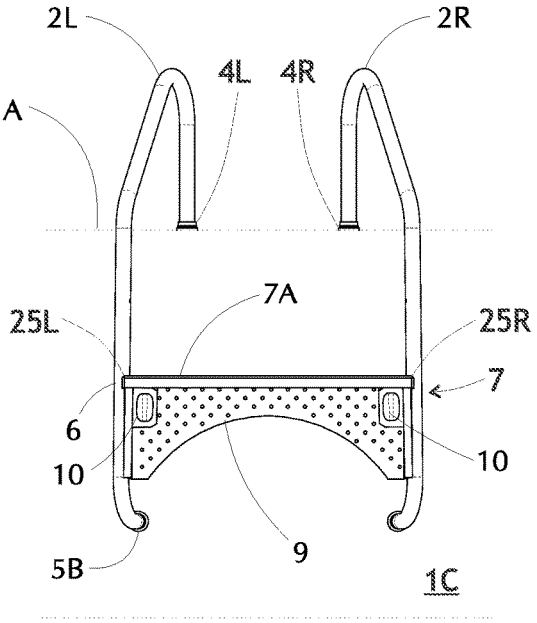

A conventional pool ladder 1 of a typical existing in-ground pool is depicted in FIGS. 1A-1C. The existing pool has a surrounding deck or patio 1A, into which two existing ladder rails 2L 2R are conjugately secured by two corresponding existing anchor sockets 4L 4R. The ladder rails 2L 2R are typically tubular stainless steel, but they can also be a tubular corrosion-resistant pvc material. In this example, the pool ladder 1 has three treads 3A 3B 3C connected by tread hardware 6 between the two rails 2L 2R. The two rails 2L 2R are mutually parallel and are both oriented perpendicular to a pool wall 1C, and they terminate below the water in a resilient bumper 5A which vertically engages the pool wall 1C and any pool liner that covers the wall.

An exemplary first embodiment of the present invention is illustrated in FIGS. 2A-2C and FIGS. 3A-3C. In this embodiment, the existing ladder rails 2L 2R, with their treads 3A 3B 3C removed, are retained in the swim out installation, and their upper socket ends 20 remain secured to the conjugate existing anchor sockets 4L 4R. In place of the removed ladder treads 3A 3B 3C, a swim out platform structure 7 is installed between the vertical support sections 21 of the rails, using the existing connective hardware apertures 6, at a submerged platform position 23.

The platform structure 7 comprises an underwater platform 7A, a rigid vertical platform panel 9, which supports from below an interior edge 24 of the platform 7A, and two rigid, substantially triangular side gussets 8L 8R, which support from below two side edges 25L 25R of the platform 7A. Optionally, the side gussets 8L 8R may support LED light bars 10 for night time illumination of the platform structure 7.

The underwater platform 7A is horizontal, flat, and substantially rectangular in shape, and is preferably fabricated from a rigid pvc plastic, as are the vertical support panel 9 and the two side gussets 8L 8R. Because the underwater platform 7A has a platform width 26 which is greater than the socket offset 27 separating the existing two anchor sockets 4L 4R, the orientation of the two ladder rails 2L 2R can no longer be mutually parallel and perpendicular to the pool wall 1C, as it was in the original pool ladder configuration shown in FIGS. 1A-1C. The rails 2L 2R are, therefore, rotated outward from the parallel orientation to a splayed configuration.

The lower terminal ends 22 of the two rails 2L 2R are capped with resilient bumpers 5B, which vertically engage the contiguous pool wall 1C, so as to protect the wall 1C and any pool liner that may be covering it.

Figure 4A:
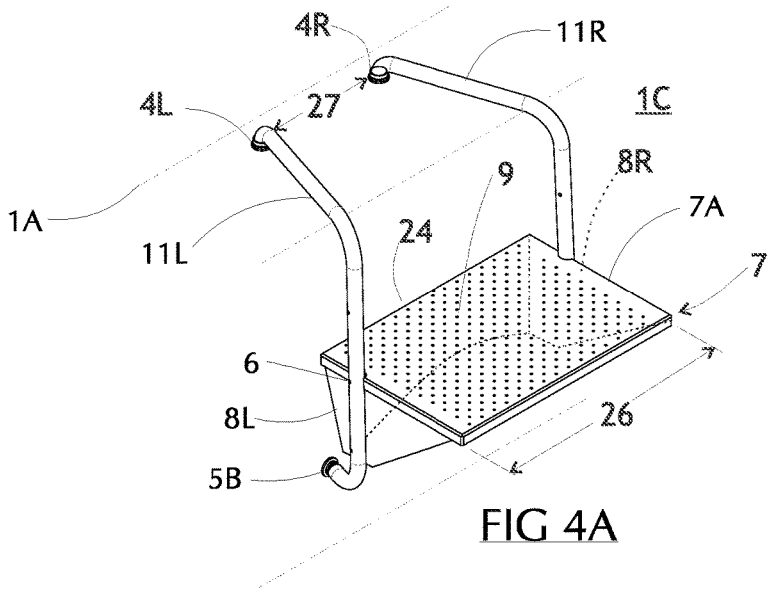
FIGS. 4A-4C are perspective, side profile and front elevation views, respectively, of a second embodiment of the present invention, which is a low profile installation for a rectangular in-ground pool.
Figure 4B:
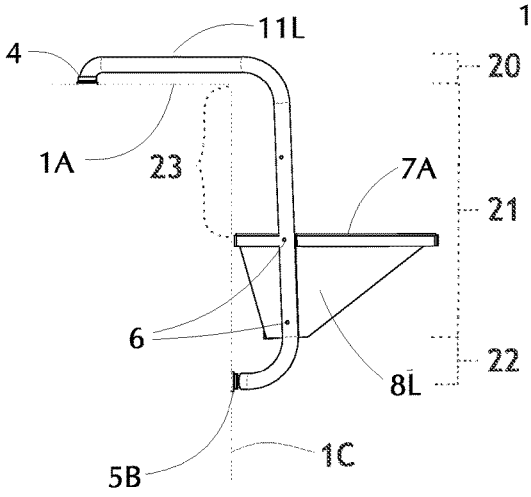
Figure 4C:
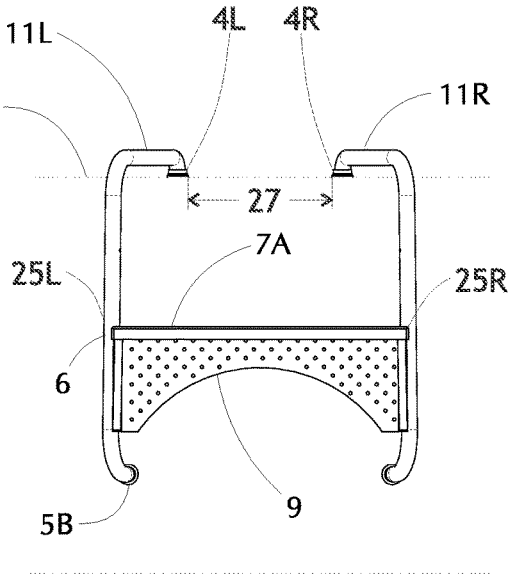

An exemplary second embodiment of the present invention is illustrated in FIGS. 4A-4C. The structural elements are the same as those described above for the first embodiment, except that the existing ladder rails 2L 2R are replaced by two low profile platform rails 11L 11R. The platform rails 11L 11R have a substantially horizontal upper socket end 20, as compared to the arched upper socket ends of the first embodiment (20 in FIG. 2B).

Figure 5A:
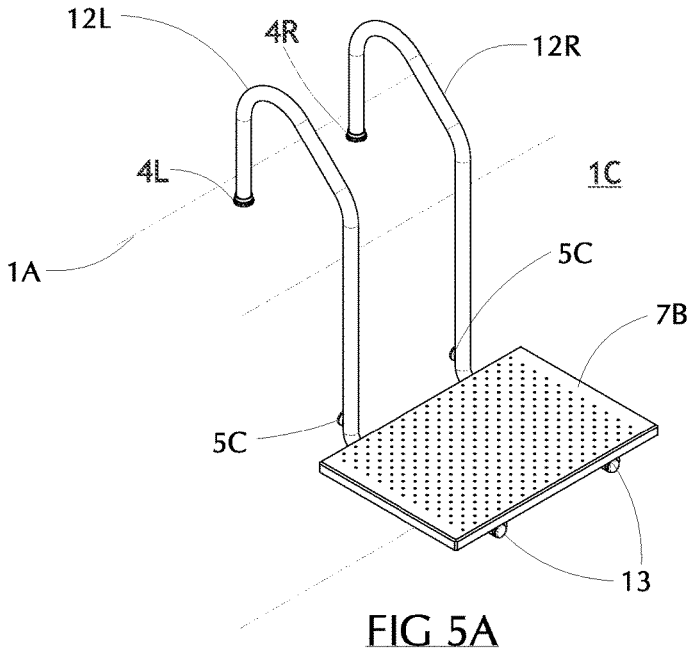
FIGS. 5A-5C are perspective, side profile and front elevation views, respectively, of a third embodiment of the present invention, which is a bench-style installation for a rectangular in-ground pool.
Figure 5B:
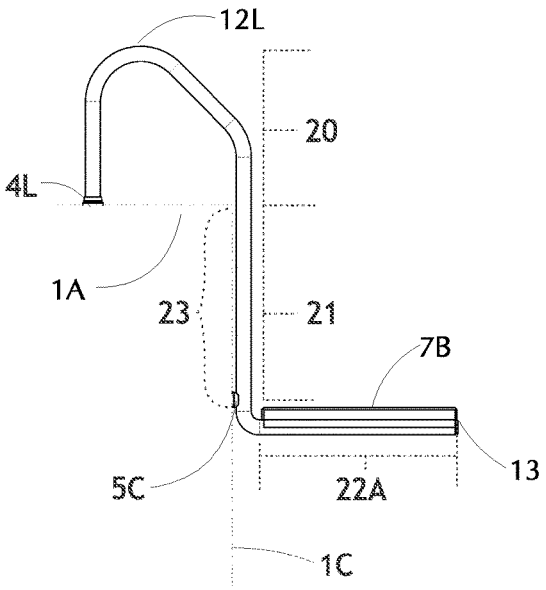
Figure 5C:
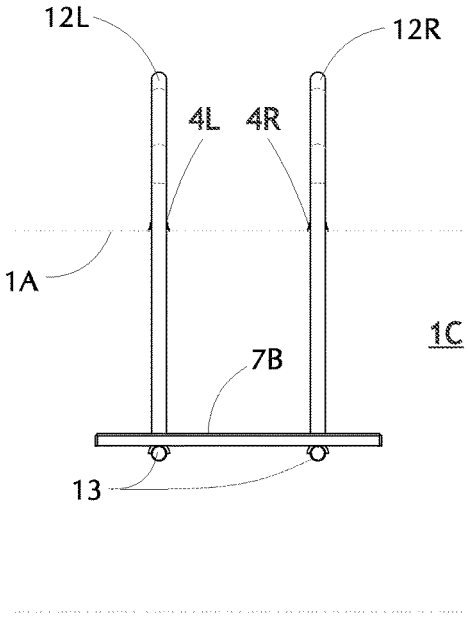

An exemplary third embodiment of the present invention is depicted in FIGS. 5A-5C. In this embodiment, the platform structure is simply the flat, substantially rectangular underwater platform 7B. The two existing ladder rails 2L 2R of the first embodiment are replaced by two platform rails 12L 12R having arched upper socket ends 20 and lower terminal ends that form horizontal support sections 22A, between which the underwater platform 7B is supported from below at the submerged platform position 23. The horizontal support sections 22A terminate in two resilient end caps 13 to cushion collisions with swimmers. Each of the vertical support sections 21 has a resilient bumper 5C facing the pool wall 1C to protect the wall and any pool liner.

Figure 6A:
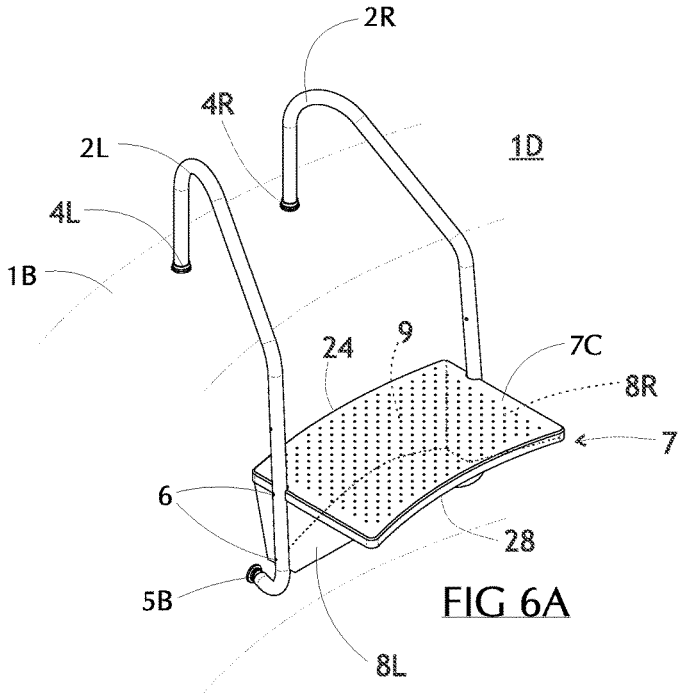
FIGS. 6A-6C are perspective, side profile and plan views, respectively, of a fourth embodiment of the present invention, which is adapted for installation in a round in-ground pool.
Figure 6B:
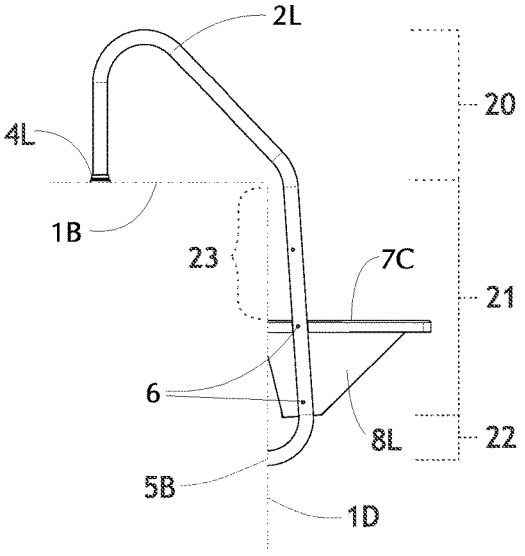
Figure 6C:
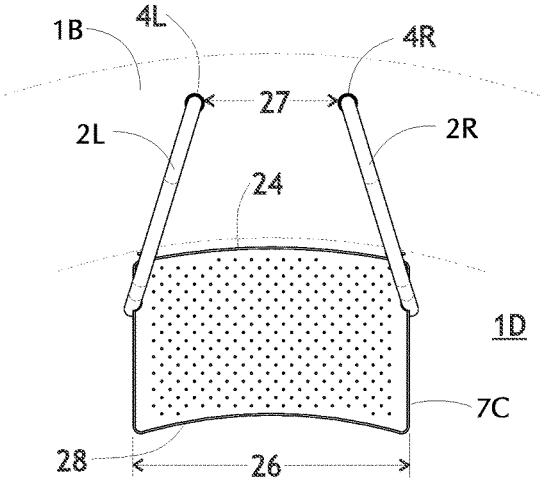

An exemplary fourth embodiment of the present invention is depicted in FIGS. 6A-6C. The elements of this installation are the same as those of the first embodiments shown in FIGS. 2A-2C, except that this fourth embodiment is designed for a pool with round walls 1D and surrounded by a round deck/patio 1B. Accordingly, the interior edge 24 and an exterior edge 28 of the underwater platform 7C form convex and concave curves, respectively, to conform to the curvature of the pool wall 1D. As in the first embodiment, the existing ladder rails 2L 2R are used to support the platform structure 7.

Figure 7A:
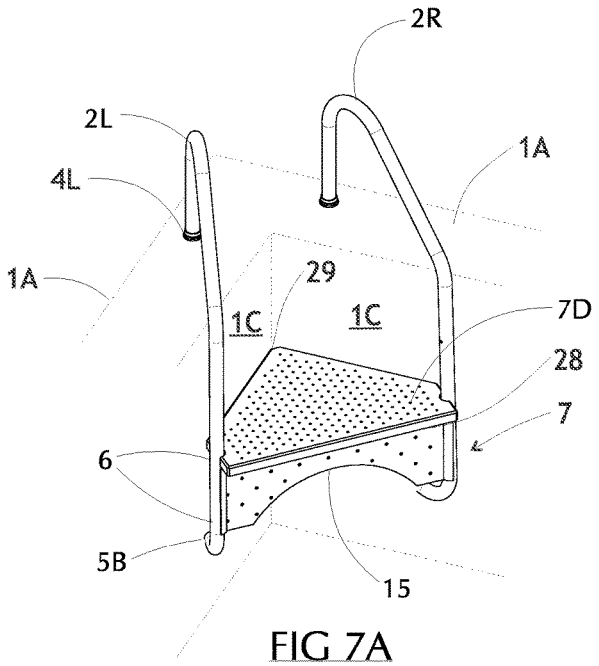
FIGS. 7A-7C are perspective, front elevation and plan views, respectively, of a fifth embodiment of the present invention, which is adapted for installation at a corner of an in-ground pool.
Figure 7B:
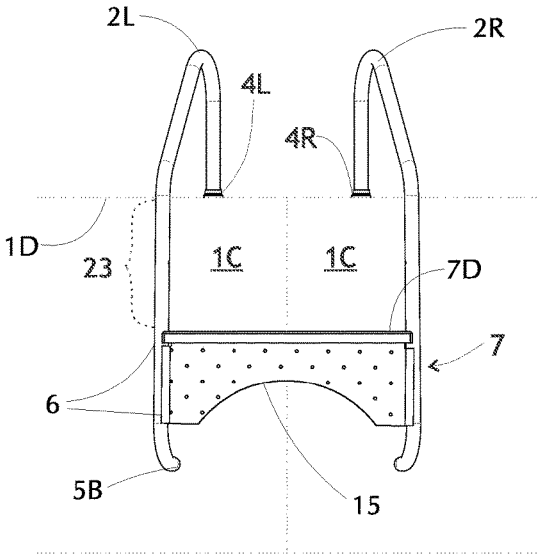
Figure 7C:
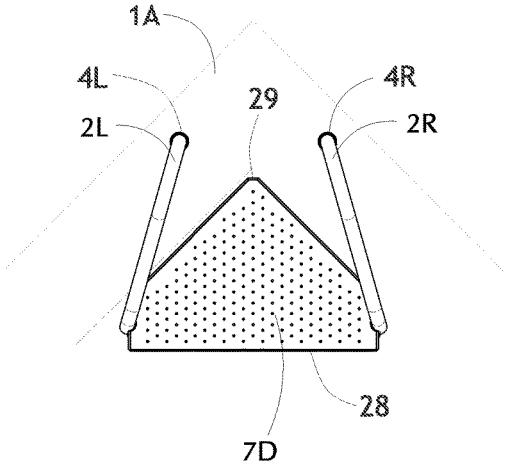

The fifth exemplary embodiment of the present invention, shown in FIGS. 7A-7C, utilizes the existing ladder rails 2L 2R to support a platform structure 7 adapted for an installation in a corner of a rectangular pool, where two pool wall 1C meet. In this case, the underwater platform 7D is substantially shaped as an irregular pentagon, having an interior vertex 29 and an exterior edge 28 opposite the interior vertex 29. The exterior edge 28 is supported from below by a rigid vertical platform panel 15, which, along with the underwater platform 7D, comprise the platform structure 7. Although a right-angled pool corner is illustrated here, this embodiment is also adaptable to an acute, obtuse or curved corner, by adjusting the shape of the interior vertex to be congruent with the contiguous pool walls 1C.

Figure 8A:
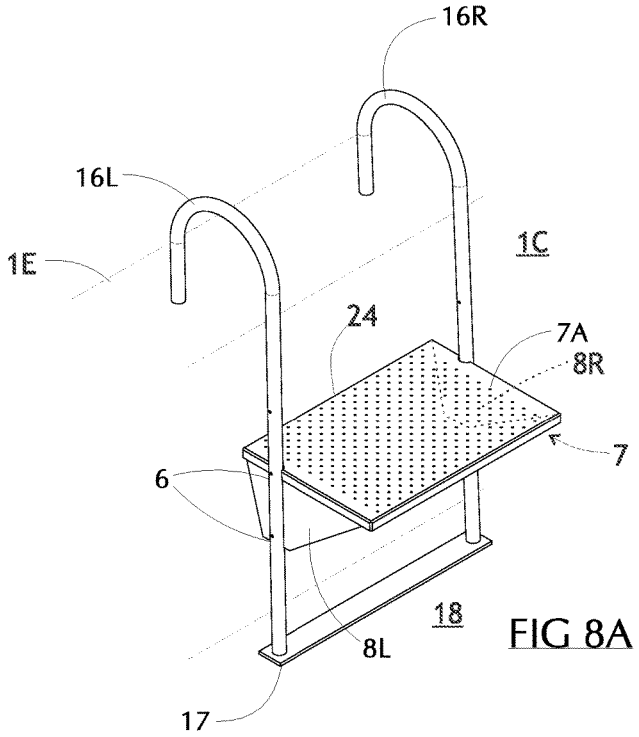
FIGS. 8A-8C are perspective, side profile and plan views, respectively, of a sixth embodiment of the present invention, which is adapted for installation in an above-ground pool.
Figure 8B:
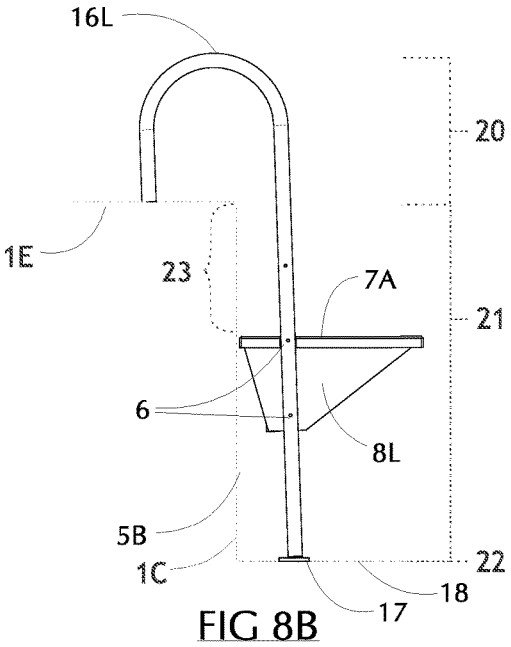
Figure 8C:
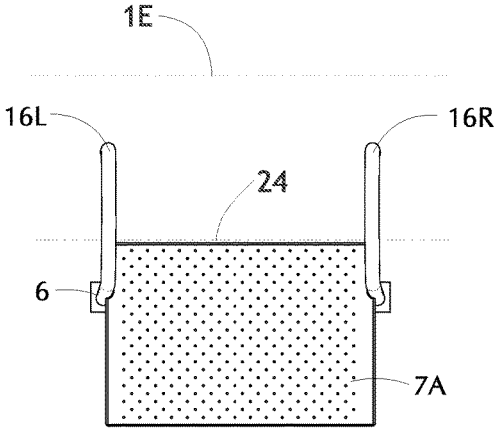

FIGS. 8A-8C depict a sixth embodiment of the present invention, which is adapted for an installation in an existing above-ground pool. This embodiment uses the ladder rails 16L 16R of an existing above-ground pool ladder with its treads extracted. The arched upper support ends 20 of the rails 16L 16R engage a deck or border 1E surrounding the pool, while the lower terminal ends 22 of the rails 16L 16R are conjoined by a flat, horizontal base plate 17 which rests on the bottom of the pool 18. A platform structure 7, comprising a flat, substantially rectangular underwater platform 7A and two supporting side gussets 8L 8R, is horizontally secured between the two vertical support sections 21 of the two ladder rails 16L 16R at a submerged platform position 23.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. An underwater platform installation in an existing swimming pool, comprising:

two existing anchor sockets in a deck or a patio surrounding the existing swimming pool, wherein the two existing anchor sockets are configured to secure two tubular existing ladder rails of an existing pool ladder, having two or more ladder treads, the two tubular existing ladder rails separated by a first distance to accommodate a width of the two or more ladder treads;

two tubular platform rails which fit into and are securable by the two existing anchor sockets, wherein each of the two platform rails comprises an upper socket end, which conjugately engages one of the two anchor sockets, a lower terminal end, and a vertical support section between the upper socket end and the lower terminal end; and a platform structure, supporting a flat underwater platform, wherein the platform structure is horizontally secured between the two platform rails at a submerged platform position, wherein the two platform rails are positionable between a first position defined by the first distance and a second position to accommodate a platform width, the platform width greater than the width of the two or more ladder treads, wherein the two platform rails are rotated outward from the first position to the second position.

2. The underwater platform installation according to claim 1, wherein the submerged platform position is located along the vertical support sections of the two platform rails.

3. The underwater platform installation according to claim 2, wherein the underwater platform is rigid, horizontally oriented, flat, and substantially rectangular, and wherein the underwater platform has an interior edge, congruently contiguous to a vertical pool wall of the existing swimming pool, and wherein the underwater platform has two side edges, which are substantially perpendicular to the interior edge, and wherein the interior edge is supported from below by a rigid vertical platform panel, and wherein the two side edges are supported from below by two rigid, substantially triangular side gussets, and wherein the platform structure comprises the underwater platform, the vertical platform panel and the two side gussets.

4. The underwater platform installation according to claim 3, wherein the lower terminal ends of the two platform rails comprises resilient bumpers which vertically engage the vertical pool wall, so as to protect the vertical pool wall and an existing pool liner covering the vertical pool wall.

5. The underwater platform installation according to claim 4, wherein in the first position the two platform rails are in a mutually parallel orientation and wherein in the second position the two platform rails are in a splayed configuration.

6. The underwater platform installation according to claim 5, wherein the interior edge has an edge curvature which is substantially congruent with a curvature of the vertical pool wall.

7. The underwater platform installation according to any one of claims 3, 5 and 6, wherein the two platform rails are formed by removing the ladder treads from the two existing ladder rails.

8. The underwater platform installation according to claim 2, wherein the underwater platform is substantially in the shape of an irregular pentagon, having an interior vertex congruently contiguous to a pool wall corner, formed by two adjoining vertical pool walls, and having an exterior edge opposite the interior vertex, and wherein the exterior edge is supported from below by a rigid vertical platform panel, and wherein the platform structure comprises the underwater platform and the vertical platform panel.

9. The underwater platform installation according to claim 8, wherein the lower terminal ends of the two platform rails comprises resilient bumpers which vertically engage one of the two vertical pool walls, so as to protect the two vertical pool walls and an existing pool liner covering the two vertical pool walls.

10. The underwater platform installation according to claim 9, wherein in the first position the two platform rails are in a mutually parallel orientation to the two vertical pool walls.

11. The underwater platform installation according to claim 10, wherein the interior vertex has a vertex curvature which is substantially congruent with a curvature of the pool wall corner.

12. The underwater platform installation according to any one of claims 8, 10 and 11, wherein the two platform rails are formed by removing the ladder treads from the two existing ladder rails.

13. The underwater platform installation according to claim 1, wherein the underwater platform is rigid, horizontally oriented, flat, and substantially rectangular, and wherein the lower terminal end of each of the two platform rails forms a horizontal support section, which is oriented perpendicular to the vertical support section, and wherein the underwater platform is secured between the horizontal support sections of the two platform rails, and wherein the underwater platform is supported from below at the submerged platform position by the horizontal support sections of the two platform rails.

14. The underwater platform installation according to claim 13, wherein the vertical support section of each of the two platform rails contains one or more resilient bumpers which vertically engage a vertical pool wall, so as to protect the vertical pool wall and an existing pool liner covering the vertical pool wall.

15. A method for retrofitting an existing ladder mounted on a structure and extending into a body of water, the existing ladder having a first and a second ladder rail having two or more ladder treads mounted therebetween such that the first and the second ladder rails are a first distance apart from one another in a substantially parallel orientation, the method comprising:

removing the two or more ladder treads from the first and the second ladder rails to expose at least a first and a second connective hardware aperture on each of the first and the second ladder rails;

moving the first and the second ladder rails outward from each other until the first and the second ladder rails are a second distance apart from one another at the first connective hardware aperture; and mounting an underwater platform structure between the first connective hardware aperture of the first ladder rail and the first connective hardware aperture of the second ladder rail.

16. The method of claim 15, wherein the body of water is a swimming pool, the method further comprising:

capping a lower terminal end of each of the first and the second ladder rail with a resilient bumper that vertically engages a wall of the swimming pool.

* * * * *